US007526885B2

(12) United States Patent
Peterson et al.

(10) Patent No.: US 7,526,885 B2
(45) Date of Patent: May 5, 2009

(54) SPLITTER GRAPPLER

(75) Inventors: Arnold N. Peterson, Eugene, OR (US); Peter B. Alford, Chesire, OR (US)

(73) Assignee: Peterson Pacific Corporation, Eugene, OR (US)

( * ) Notice: Subject to any disclaimer, the term of this patent is extended or adjusted under 35 U.S.C. 154(b) by 127 days.

(21) Appl. No.: 11/609,203

(22) Filed: Dec. 11, 2006

(65) Prior Publication Data

US 2007/0130808 A1 Jun. 14, 2007

Related U.S. Application Data

(60) Provisional application No. 60/750,239, filed on Dec. 13, 2005.

(51) Int. Cl.
*E02F 3/96* (2006.01)
*A01G 23/08* (2006.01)

(52) U.S. Cl. ..... 37/406; 37/410; 37/302; 144/4.1; 414/722

(58) Field of Classification Search ..... 37/406, 37/302, 303, 408–410; 414/722; 144/4.1, 144/34.1, 24.12
See application file for complete search history.

(56) References Cited

U.S. PATENT DOCUMENTS 3,482,614 A * 12/1969 Griffin et al. ..... 144/34.1
3,517,711 A * 6/1970 Anderson et al. ..... 83/796
RE26,992 E * 11/1970 Rehnstrom ..... 144/34.5
3,664,391 A * 5/1972 Coffey ..... 83/151
3,719,314 A * 3/1973 Cox ..... 225/97
3,785,415 A * 1/1974 Taponen ..... 144/34.1
3,814,152 A * 6/1974 Pallari ..... 144/24.12
3,915,211 A * 10/1975 Barwise ..... 144/339
4,057,087 A * 11/1977 Oldenburg ..... 144/34.5
4,069,848 A * 1/1978 Coatta ..... 144/34.5
4,088,163 A * 5/1978 Levesque ..... 144/34.5
4,100,951 A * 7/1978 Fischer ..... 144/339
4,127,154 A * 11/1978 Kabotoff ..... 144/4.1
4,183,690 A * 1/1980 Moery et al. ..... 403/59
4,198,747 A * 4/1980 LaBounty ..... 30/134
4,273,169 A * 6/1981 Baenen ..... 144/34.1
4,274,457 A * 6/1981 Nilsen ..... 144/34.1
4,670,983 A * 6/1987 Ramun et al. ..... 30/134
4,908,946 A * 3/1990 Labounty ..... 30/134
5,004,026 A * 4/1991 MacLennan et al. ..... 144/4.1
5,044,569 A * 9/1991 LaBounty et al. ..... 241/266
5,142,779 A * 9/1992 LaBounty ..... 30/134
5,320,149 A * 6/1994 Peterson et al. ..... 144/4.1
5,472,249 A 12/1995 Fiedler
6,026,869 A * 2/2000 Holmes ..... 144/4.1
6,058,632 A * 5/2000 Hawkins ..... 37/406
6,076,572 A 6/2000 Cook (Continued)

FOREIGN PATENT DOCUMENTS

DE 2743010 * 4/1975

(Continued)

*Primary Examiner*—Thomas A Beach
(74) *Attorney, Agent, or Firm*—Schwabe, Williamson & Wyatt, P.C.

(57) ABSTRACT

A wood splitting grappler is provided which may grab debris, split debris and move the debris to a desired location such as a materials reducing machine for further processing or disposition.

11 Claims, 6 Drawing Sheets

U.S. PATENT DOCUMENTS

| | | | | |
|---|---|---|---|---|
| 6,176,531 | B1 * | 1/2001 | Wheeler | 294/88 |
| 6,655,053 | B1 * | 12/2003 | Cummungs | 37/403 |
| 2005/0115638 | A1 * | 6/2005 | Solesbee | 144/4.1 |
| 2005/0211337 | A1 | 9/2005 | Sharp | |

FOREIGN PATENT DOCUMENTS

| | | | |
|---|---|---|---|
| JP | 2001-186821 | A | 7/2001 |
| JP | 2002256711 | * | 9/2002 |
| WO | WO 2007063166 | A1 * | 6/2007 |

* cited by examiner

SPLITTER GRAPPLER

CROSS-REFERENCE TO RELATED APPLICATIONS

The present application is a continuation-in-part of and claims priority to U.S. Provisional Patent Application No. 60/750,239, filed Dec. 13, 2005, entitled "WOOD SPLITTING GRAPPLE," the entire disclosure of which is hereby incorporated by reference in its entirety.

FIELD

The present invention relates generally to the field of attachments for excavators, timber harvesting, and clearing equipment, and more particularly to a wood splitting grapple attachment adapted to controllably handle and split stumps and other debris.

BACKGROUND

Harvesting equipment, excavators, and other implements (referred to herein generically as excavators) are often used to clear areas of wood, stumps and other debris. These machines often are responsible for picking up the debris and feeding it into a grinder, recycler or other machine adapted to size reduce material. When a stump, chunk, log or other piece of debris is encountered that is too big for the size reducing machine being used, such debris must be split into smaller pieces, or must be handled separately. Some machines may have a wood splitter attachment that replaces a grapple device on an excavator, for example, that will accomplish the splitting function. These splitter attachments, however, are not adapted for conveniently grabbing and loading the debris into the size reducing machine for further processing.

BRIEF DESCRIPTION OF THE DRAWINGS

Embodiments of the present invention will be readily understood by the following detailed description in conjunction with the accompanying drawings. Embodiments of the invention are illustrated by way of example and not by way of limitation in the figures of the accompanying drawings.

DETAILED DESCRIPTION OF EMBODIMENTS OF THE INVENTION

Figure 1A:
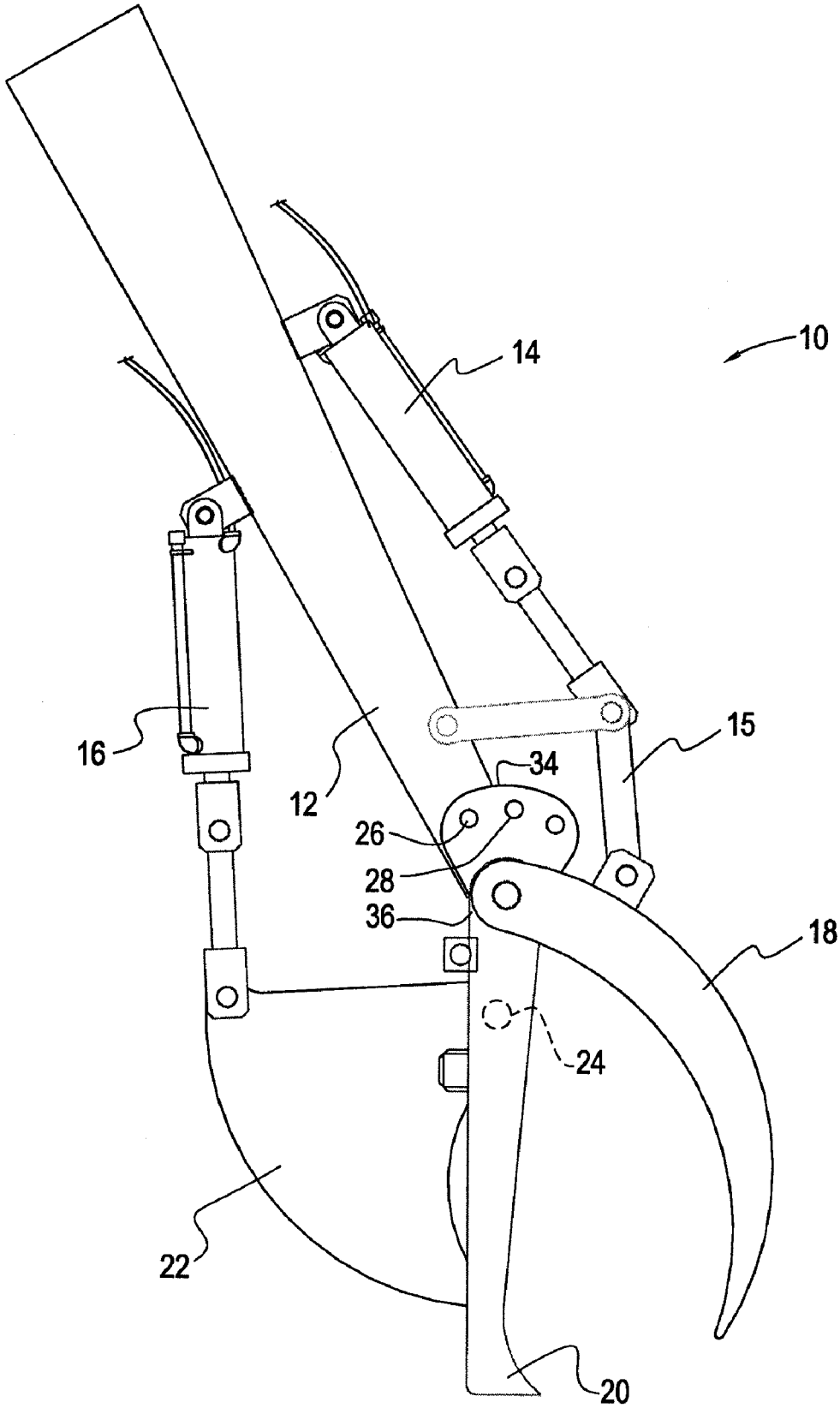
FIGS. 1A, 1B, and 1C illustrate respective side, front perspective and rear perspective views in accordance with various embodiments of the present invention.

In the following detailed description, reference is made to the accompanying drawings which form a part hereof, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the description, a phrase in the form "A/B" means A or B. For the purposes of the description, a phrase in the form "A and/or B" means "(A), (B), or (A and B)." For the purposes of the description, a phrase in the form "at least one of A, B, and C" means "(A), (B), (C), (A and B), (A and C), (B and C), or (A, B and C)." For the purposes of the description, a phrase in the form "(A)B" means "(B) or (AB)" that is, A is an optional element.

The description may use the phrases, "in various embodiments," "in an embodiment," or "in embodiments," which may each refer to one or more of the same or different embodiments. Furthermore, the terms "comprising," "including," "having," and the like, as used with respect to embodiments of the present invention, are synonymous.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Embodiments of the present invention may include an attachment for an excavator that may function as a grapple for loading or handling of debris, a splitter for oversized debris, and/or an attachment that is adapted to grab, split, and load a piece of oversized debris into a size reducing machine, or otherwise dispose thereof, in an efficient and safe manner.

In various embodiment of the present invention, a debris splitting grapple may replace the bucket that normally attaches to the stick of an excavator, for example. In one embodiment, the existing hydraulic cylinder that attaches to the bucket by way of the existing excavator linkage may power the front of the grapple. As many excavators and other machines have an auxiliary hydraulic circuit and cylinder, often used to operate a thumb, for example, the auxiliary or thumb cylinder may either attach to the rear portion of the grapple, and/or to the splitter knife. Depending on which component the auxiliary cylinder is attached will determine which component is controlled by actuation of the auxiliary cylinder.

Figure 1B:
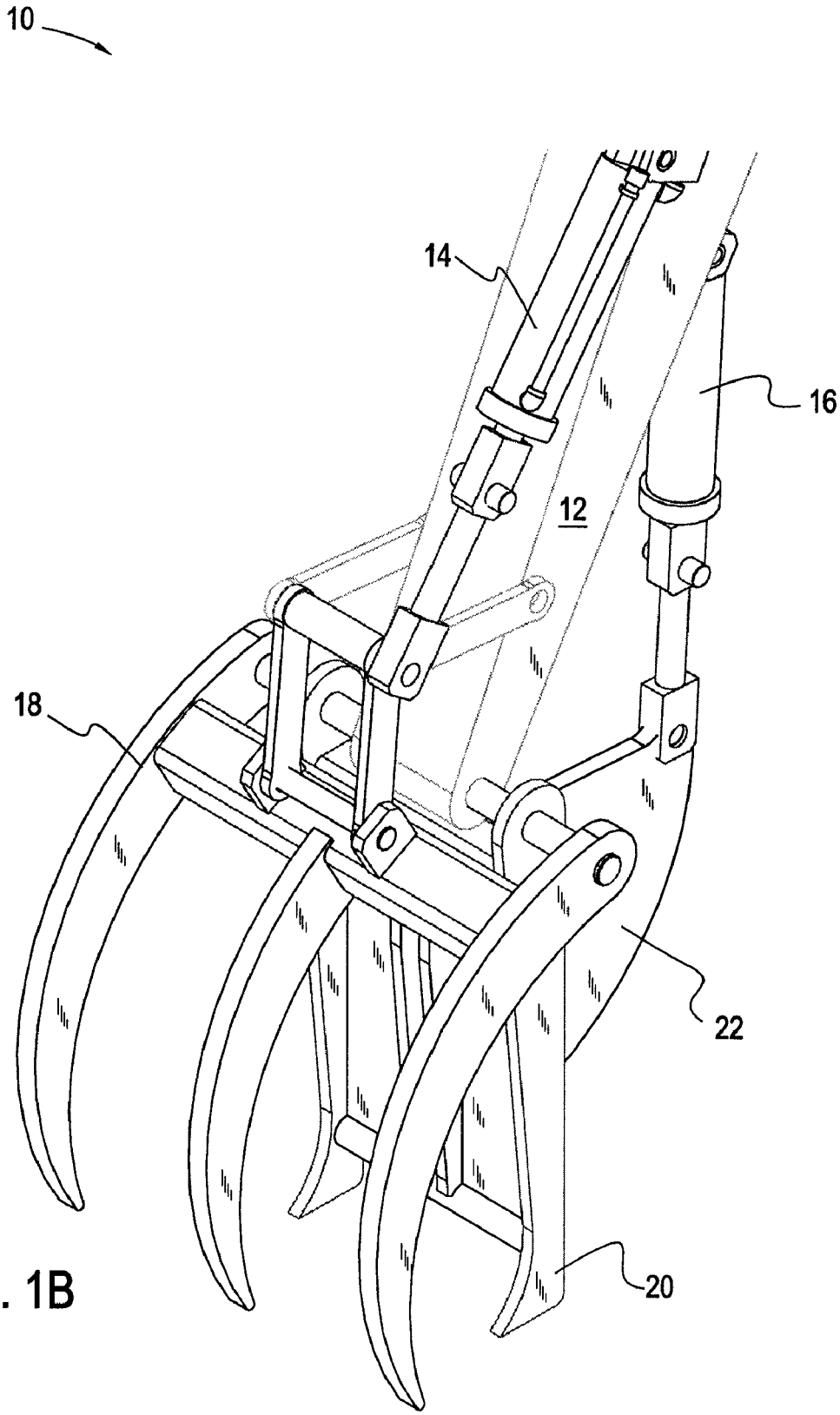
Figure 1C:
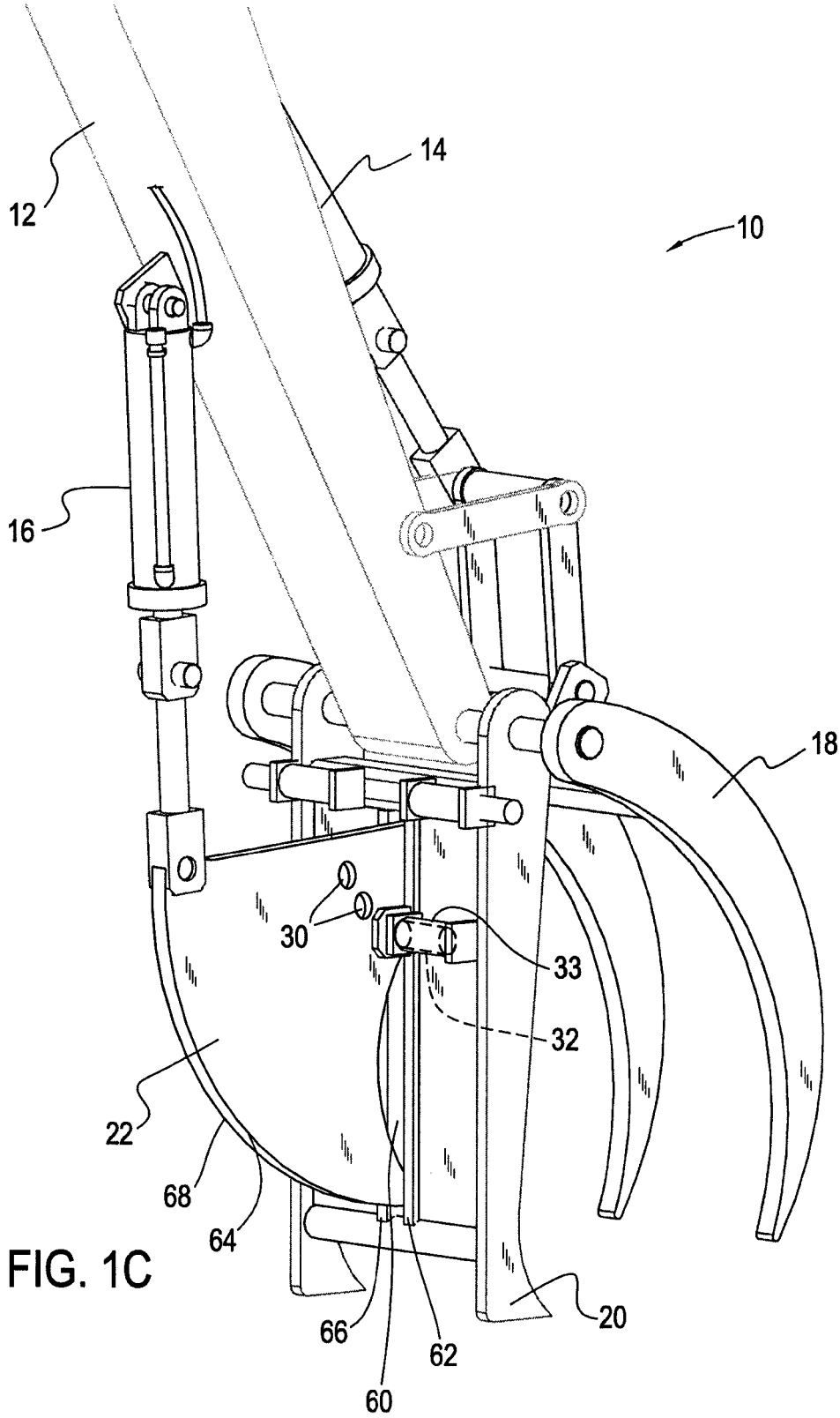

FIG. 1A is a side view and FIGS. 1B and 1C are perspective views illustrating various embodiments in accordance with the invention. A splitting grapple 10, such as a grapple for splitting wood, may be adapted to be controllably attached to an excavator stick 12. The excavator stick 12 may be of the type having a front hydraulic cylinder 14 and a rear, or auxiliary, hydraulic cylinder 16. The splitting grapple 10 may include a front grapple portion 18 adapted to be pivotally coupled to the stick 12. The front grapple portion 18 may be further adapted to be pivoted by the front hydraulic cylinder 14, via an excavator linkage 15.

A rear grapple portion 20 may be provided and also adapted to be pivotally coupled to the stick 12. The front grapple portion 18 and the rear grapple portion 20 may be further adapted to cooperate in order to grab an object (not shown). A knife 22 may be adapted to be, directly or indirectly, coupled to the stick 12 and may be adapted to pivot with respect to, or in conjunction with, the rear grapple portion 20 to split and/or to cut the object. At least one of the rear grapple portion 20 and the knife 22 may be adapted to be operatively coupled with the rear hydraulic cylinder 16 to effect the pivoting of one or both of the rear grapple portion 20 and the knife 22. As illustrated, various embodiments may include the knife 22 pivotally coupled with the rear grapple portion 20 at hinge point 24.

In one embodiment where the auxiliary, or back, cylinder 16 may be coupled to the knife, the rear portion of the grapple may be fixed or pinned at a point relative to the stick. In one embodiment, a member that fixes the rear grapple portion to the excavator stick may have multiple pin locations to vary the operating angle.

In various embodiments, a releasable locking mechanism may be used to engage and disengage the knife with the rear grapple portion 20. In such embodiments, the auxiliary cylinder on the stick may be attached to the knife, and thus control both the grapple and the knife. A variety of manual and automatic releasable locking mechanisms may be used, including, but not limited to a sliding pin that may be actuated hydraulically, or pneumatically, or the like, to lock and unlock the knife to the grapple portion as desired. There may be several locking positions available so that the rear portion of the grapple can be locked at different angles. In various embodiments, the knife may be selectively locked and unlocked to the excavator stick.

Referring to FIG. 1C, the knife 22 may include a number of holes 30 adapted to received a pin 32 adapted for extension and retraction in piston 33. The piston 33 may be rigidly coupled with rear grapple portion 20.

When the rear grapple portion is locked to the knife, the rear grapple portion and the knife may rotate together. Such a configuration may allow normal grapple operation, such as loading the grinder. When the rear grapple portion is locked to the excavator stick, the grapple portion may remain stationary and the rear cylinder may force the knife forward through the rear grapple portion and into the wood.

For example, as illustrated in FIG. 1A a flange 34 may be attached or made integral with a first end 36 of the rear grapple portion 20. The flange 34 may include multiple openings 26 adapted to receive a retractable pin 28 which may be, for example, mounted on the stick 12 or adapted to engage the stick 12. The pin 28 may be actuated via various methods including but not limited to, manually, hydraulically, and/or pneumatically, and may also be controlled by mechanical linkage, electrical coupling and/or wirelessly.

In another embodiment, the rear cylinder 16 may be coupled to the rear grapple portion 20, and the knife 22 may be pinned or fixed relative to rear grapple portion 20, or the stick 12. Where the knife 22 is fixed to the rear portion of the grapple, the amount of knife that may be adapted to engage a piece of debris may be controllably adjusted as desired.

In various embodiments, a knife guide for the knife may be built into the rear grapple portion. For example, as illustrated in FIG. 1C, a knife guide 60 may include a first guide member 62 disposed adjacent a first side 64 of the knife 22 and a second guide member 66 disposed opposite the first guide member 62 and adjacent a second side 68 of the knife 22. The knife guide 60 may be used as both a guide for the knife, as well as to provide for lateral support for the knife 22. In one embodiment, during full retraction of the knife, the knife may still be engaged with the guide. Such support and guidablility may provide added stability and functionality by allowing the knife 22 to withstand higher forces that may be encountered during a splitting operation.

In various embodiments of the present invention, where only two hydraulic circuits are provided on a stick, a hydraulic valve may be used to shift the auxiliary hydraulic circuit to operate one or more knife actuating cylinders or one or more rear grapple portion actuating cylinders. The hydraulic valve may be located on the excavator machine, on the stick, or on the splitting grapple, and may be operated in a variety of ways, including, but not limited to electrically, manually, and the like. With such a valve, an oversized object may be gripped by both portions of the grapple when the valve is positioned such that the auxiliary circuit is operating the auxiliary cylinder controlling the rear grapple portion. The valve may then be shifted to the knife cylinder in order to complete the splitting of the object, and then shifted rear to resume grapple operation.

Such use of a valve arrangement and/or other control device that is adapted to switch the piece in which the auxiliary circuit controls at a given time may be a cost-effective solution to enabling controlling of all three parts without adding a separate third hydraulic circuit to the stick. In another embodiment, however, a third hydraulic circuit and a third cylinder may be provided, such that both the rear portion of the grapple and the splitter knife may be independently and controllably actuated.

Figure 2:
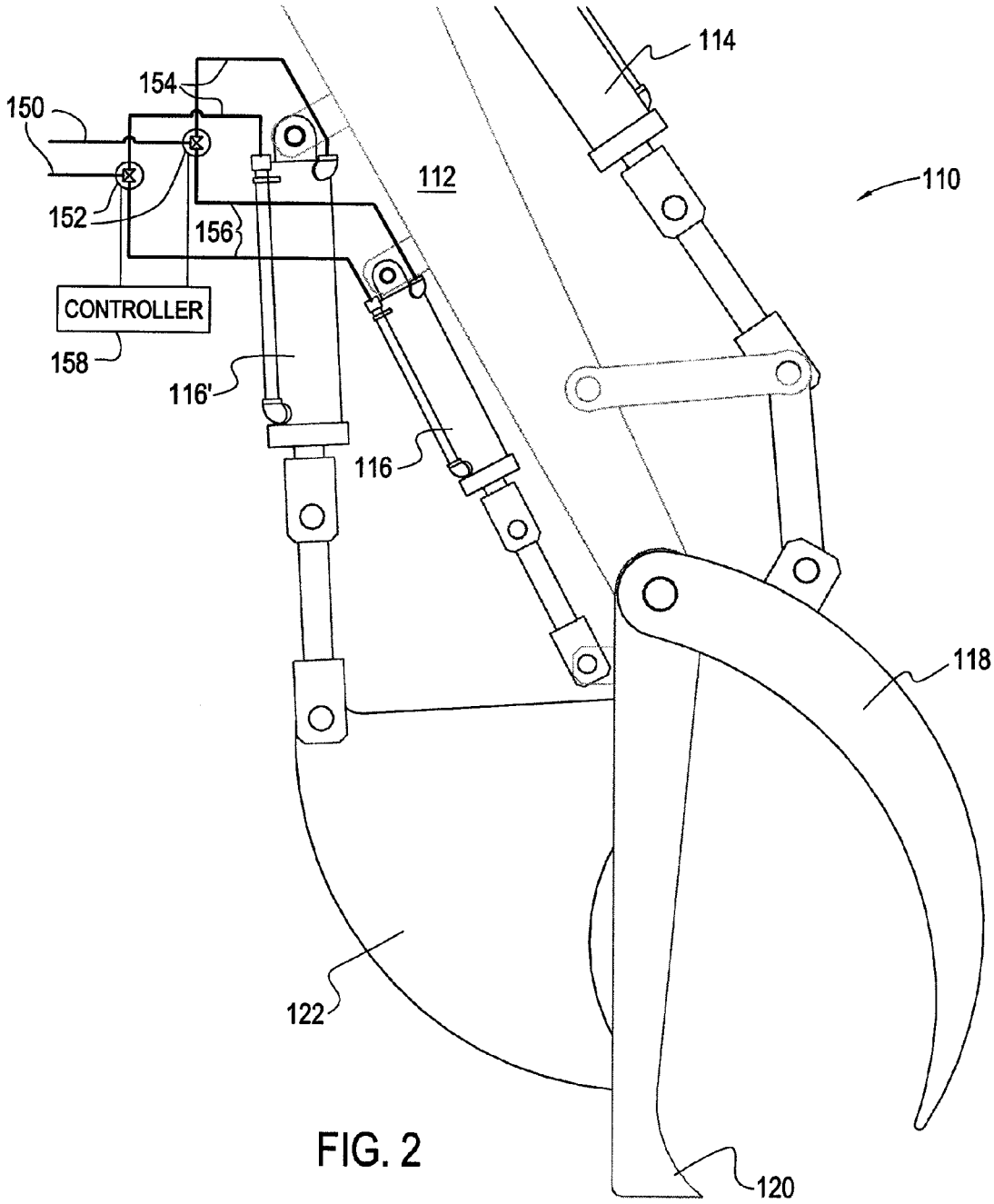
FIG. 2 illustrates partial side and partial schematic view in accordance with various embodiments of the present invention.

FIG. 2 is a partial side view and partial schematic view illustrating various embodiments in accordance with the invention. As illustrated, a splitter grappler 110 may include a first grappler portion 118 which may be operatively coupled with an excavator stick 112 for pivoting relative thereto, and adapted to be actuated by a first hydraulic cylinder 114. A second grappler portion 120 may also be operatively coupled to the excavator stick 112 and adapted to pivot relative thereto. A knife 122 may be pivotally coupled to the second grappler portion 120 as illustrated. In other embodiments the knife 122 may be pivotally coupled directly to the stick 112. One or more first auxiliary cylinders 116 may be adapted to actuate the second grappler portion 120, and one or more second auxiliary cylinders 116' may be adapted to actuate the knife 122. Power from auxiliary hydraulic lines 150 from the excavator (not shown) may be selectively directed to one of either the first auxiliary hydraulic cylinder 116 or the second auxiliary hydraulic cylinder 116', with valves 152 via first supplemental auxiliary hydraulic lines 154, and second supplemental auxiliary hydraulic lines 156. A controller 158 may be adapted to control the flow of hydraulic fluid with valves 152.

Figure 3:
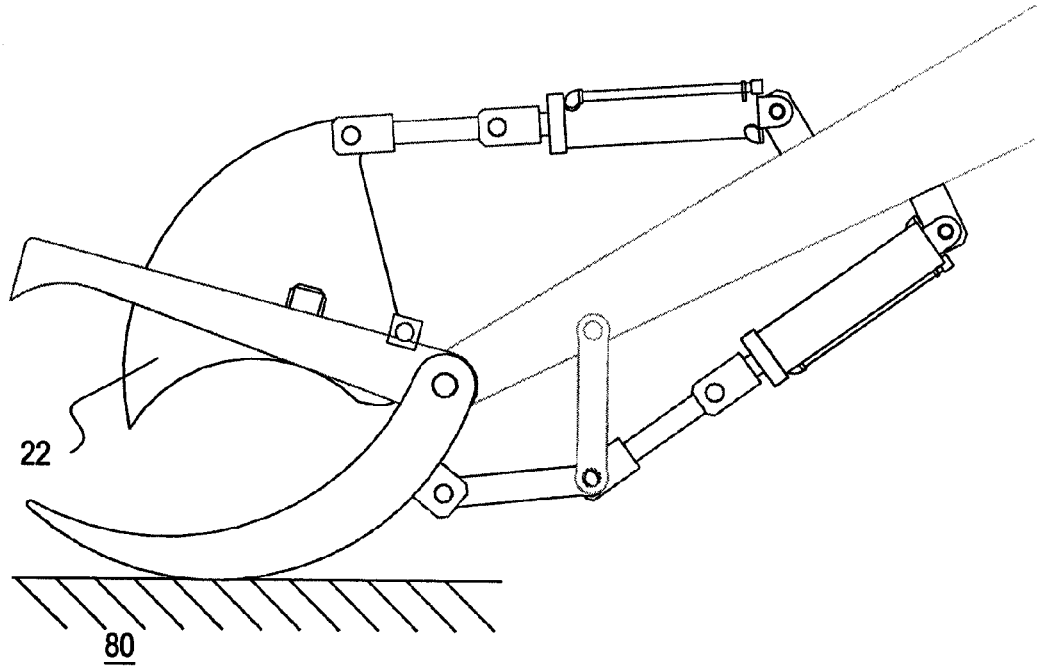
FIG. 3 illustrates a side view in accordance with various embodiments of the present invention.

FIG. 3 is a side view illustrating various embodiments in accordance with the invention. When an oversized object is picked up, the operator may curl the grapple so that the front of the grapple rests on the ground 80, then actuate the knife 22 to split the object by forcing the knife into the wood. The front of the grapple may be supported by the ground 80 during splitting.

In one embodiment, the knife may share the same pivot point as the grapple portions. In another embodiment, the knife may pivot on a different pivot point than the grapple portions. It can be appreciated that the grapple shape and size can vary depending on the particular application. For example, while the front grapple portion may be generally curved, the rear portion may be straight, curved or otherwise adapted for use with the debris being handled.

Figure 4:
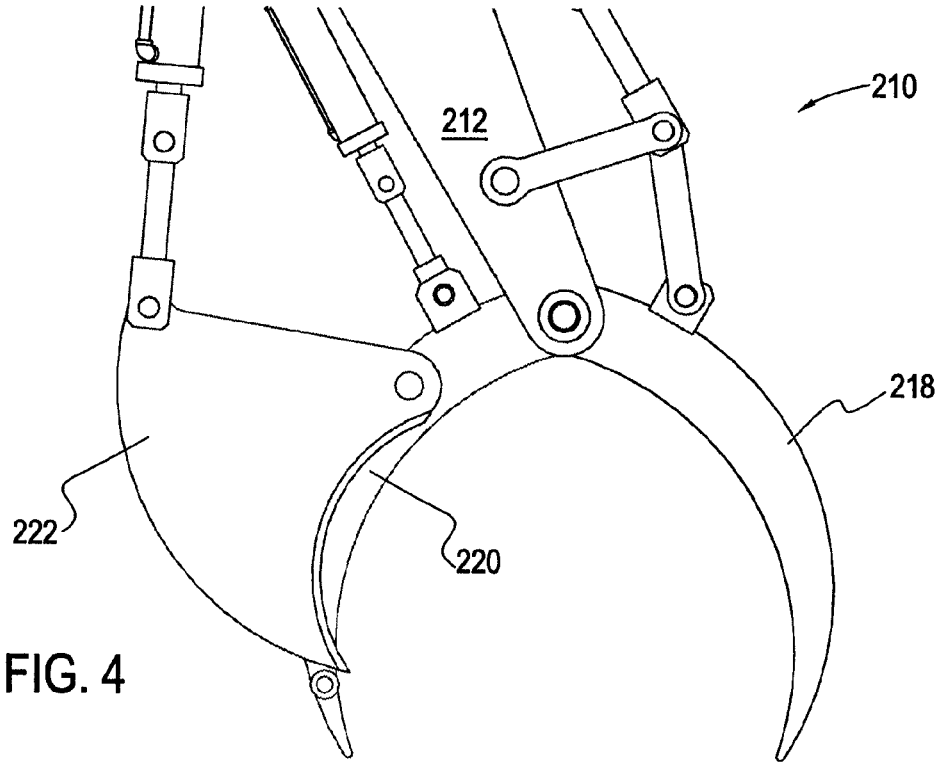
FIG. 4 illustrates a side view in accordance with various embodiments of the present invention.

FIG. 4 is a side view illustrating various embodiments in accordance with the invention. Portions have been removed for illustration. A splitter grappler 210 may include a curved front grapple portion 218 pivotally coupled with a stick 212 of an excavator. A rear grapple portion 220 may also be coupled with a stick 212 and may also be curved. A knife 222 may be pivotally coupled with the rear grapple portion 220.

Figure 5:
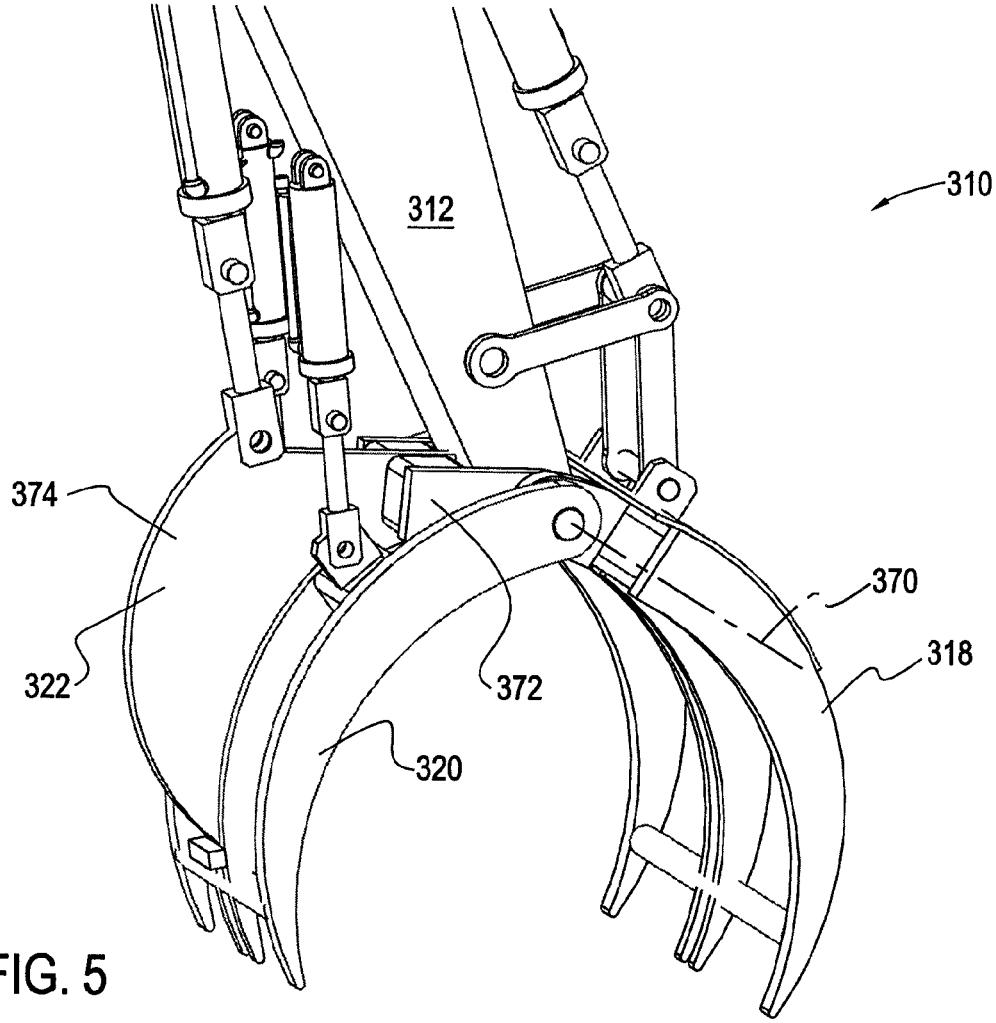
FIG. 5 illustrates a perspective view in accordance with various embodiments of the present invention.

FIG. 5 is a perspective view illustrating various embodiments in accordance with the invention. A splitter grappler 310 may include a curved front grapple portion 318 pivotally coupled with a stick 312 of an excavator, and a curved rear grapple portion 320 also be coupled with a stick 312. Each of the front and rear grapple portions 318, 320 may be adapted to pivot about a pivot axis 370. A knife 322 may be coupled directly to the stick 312 and may be adapted to pivot about the same pivot axis 370. The knife 322 may include an arm 372 coupled with a knife body 374 at a first end and adapted to pivot on the stick at a second end. In various embodiments, the arm 372 may be made integral with the knife body or attached thereto using various methods of attachment.

Figure 6A:
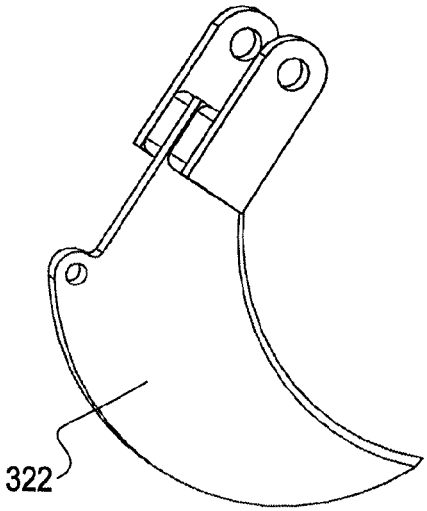
FIGS. 6A and 6B illustrate perspective views in accordance with various embodiments of the present invention.
Figure 6B:
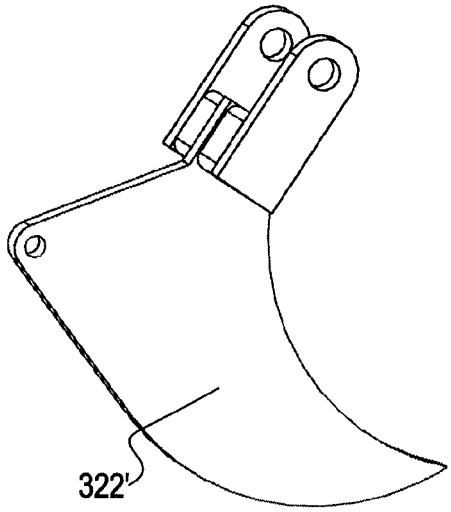

FIGS. 6A and 6B are perspective views illustrating various knives 322 and 322' in accordance with various embodiments of the invention. The figures illustrate two of many various shapes and configurations that may be possible in accordance with various embodiments of the invention. For example, the coupling of the blade may be varied to better accommodate different hydraulic systems, modify the knife path, etc. The configuration and/or material of the blade and/or cutting portion may likewise be varied depending on a variety of factors, such as debris being split, grapple configurations, etc.

In various embodiments, the front grapple portion may be the portion in which the knife engages, moves relative to, and/or fixes to, and the rear grapple portion may be the portion that moves independent of a relationship with the knife.

In one embodiment, a wood splitting grapple adapted to controllably attach to an excavator type stick may be provided that includes:

A front grapple half pivotally coupled to the stick at a first pivot point and movable about the first pivot point by a first hydraulic cylinder;

A rear grapple half operationally coupled to the stick and pivotable about the first pivot point, the front grapple half and the rear grapple half adapted to cooperate in order to grab a piece of debris; and A knife operationally coupled to stick and pivotable about a second pivot point (which may be the same as the first pivot point), the knife adapted to move with respect to or in conjunction with the rear grapple half to split the piece of debris.

Although specific embodiments have been illustrated and described herein for purposes of description of the preferred embodiment, it will be appreciated by those of ordinary skill in the art that a wide variety of alternate and/or equivalent implementations may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A debris splitting grappler adapted to be controllably attached to an excavator stick of the type having a first hydraulic cylinder and a second hydraulic cylinder comprising:

a first grappled portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjunction with the second grapple portion to split and/or cut the object, at least one of the second grapple portion and/or the knife operatively coupled to a second cylinder to effect the pivoting of one or both of the second grapple portion and the knife;

wherein the second grapple portion is movably fixed relative to the stick; and wherein the second grapple portion includes a fixing member that allows the second grapple portion to be fixed relative to the stick at a number of predetermined positions.

2. A debris splitting grappler adapted to be controllably attached to an excavator stick of the type having a first hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjunction with the second grapple portion to split and/or cut the object, at least one of the second grapple portion and/or the knife operatively coupled to a second cylinder to effect the pivoting of one or both of the second grapple portion and the knife;

wherein the knife is fixed such that it does not move relative to the second grapple portion; and wherein the knife is adapted to be fixed to the second grapple portion and/or stick at a number of predetermined positions.

3. A debris splitting grappler adapted to be controllably attached to an excavator stick of the type having a first hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjunction with the second grapple portion to split and/or cut the object, at least one of the second grapple portion and/or the knife operatively coupled to a second cylinder to effect the pivoting of one or both of the second grapple portion and the knife; and a releasable locking mechanism to be used to engage and disengage the knife with the second grapple portion.

4. A debris splitting grappler adapted to be controllably attached to an excavator stick of the type having a first hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjunction with the second grapple portion to split and/or cut the object, at least one of the second grapple portion and/or the knife operatively coupled to a second cylinder to effect the pivoting of one or both of the second grapple portion and the knife; and wherein the second hydraulic cylinder is coupled to and actuates the second grapple portion, and further comprising a third hydraulic cylinder coupled to and that actuates the knife.

5. The debris splitting grappler of claim 4, further comprising one or move valves adapted to selectively control hydraulic power to one of the second and third cylinders.

6. A debris splitting grapple adapted to be controllably attached to an excavator stick of the type having a first hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjunction with the second grapple portion to split and/or cut the object, at least one of the second grapple portion and/or the knife operatively coupled to a second cylinder to effect the pivoting of one of both of the second grapple portion and the knife; and wherein the excavator stick include a main hydraulic line and an auxiliary hydraulic line, the auxiliary hydraulic line is bifurcated to selectively manipulate the second grapple portion and the knife.

7. A debris splitting grappler adapted to be controllably attached to an excavator stick of the type having a frist hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjuction with the second grapple portion to split and/or cut the object, at least one of the second grapple portion and/or the knife operatively coupled to a second cylinder to effect the pivoting of one or both of the second grapple portion and the knife; and wherein the first grapple portion and the second grapple portion are pivotally coupled to the stick at a first pivot point; and the knife is pivotable about a second pivot point, the knife adapted to move with respect to or in conjunction with the second grapple half to split the debris.

8. A debris splitting grappler adapted to controllably attached to an excavator stick of the type having a first hydraulic cylinder and a second hydraulic cylinder comprising:

a first grapple portion adapted to be pivotally coupled with the stick and adapted to be pivoted by the first hydraulic cylinder;

a second grapple portion adapted to be coupled with the stick, the first grapple portion and the second grapple portion adapted to cooperate in order to grab an object of debris;

a knife adapted to be coupled with the stick and adapted to pivot with respect to or in conjuction with the second grapple portion to split and/or cut the object, at least one of the second grapple portion and/or the knife operatively coupled to a second cylinder to effect the pivoting of one or both of the second grapple portion and the knife; and a knife support coupled with the second grappler element and able to at least partially support the knife while the knife pivots relative to the second grappler element.

9. An apparatus, comprising:

a first grappler element adapted to be pivotally coupled to an excavator stick and actuatable for pivoting movement by a first hydraulic cylinder coupled to the excavator stick;

a second grappler element adapted to be pivotally coupled to the excavator stick and able to cooperate the the first grappler element to grab an object;

a knife adapted to pivot relative to the first grappler element and adapted to contact the object, one or both of the second grappler element and the knife actuatable for pivoting movement by a second hydraulic cylinder coupled to the excavator stick;

a third hydraulic cylinder coupled with and able to effect pivoting of one of the second grappler element and the knife, and the second hydraulic cylinder coupled with and able to effect pivoting of the other of the second grappler element and the knife; and a valve arrangement disposed to selectively provide hydraulic power and effect actuation of the second hydraulic cylinder or the third hydraulic cylinder.

10. An excavator of the type having a stick, a primary hydraulic cylinder, and an auxiliary cylinder, comprising:

a first grappler element pivotally coupled to the stick of the excavator and actuatable for pivoting movement by the primary hydraulic cylinder;

a second grappler element pivotally coupled to the excavator stick and able to cooperate with the first grappler element to grab an object; and a knife pivotally coupled to one of the excavator stick or the second grappler element able to contact the object for splitting the object, one of the second grappler element and the knife being actuatable by the auxiliary hydraulic cylinder; and wherein the excavator includes an auxiliary hydraulic circuit, and further comprising a second auxiliary hydraulic cylinder, the other of the second grappler element and the knife being actuatable by the second auxiliary hydraulic cylinder, and a valve arrangement for selectively providing hydraulic power from the auxiliary hydraulic circuit to one of the auxiliary hydraulic cylinder and the second auxiliary hydraulic cylinder.

11. The excavator of claim 10 wherein the second auxiliary hydraulic cylinder is a pair of second auxiliary hydraulic cylinders each coupled with the auxiliary hydraulic circuit for actuation.

* * * * *

UNITED STATES PATENT AND TRADEMARK OFFICE

CERTIFICATE OF CORRECTION

PATENT NO. : 7,526,885 B2
APPLICATION NO. : 11/609203
DATED : May 5, 2009
INVENTOR(S) : Arnold N. Peterson and Peter B. Alford It is certified that error appears in the above-identified patent and that said Letters Patent is hereby corrected as shown below:

Column 6
Line 1, "...a first grappled portion..." should read --...a first grapple portion....--.

Column 7
Line 17, "... one or move valves..." should read --...one or more valves....--.
Line 19, "A debris splitting grapple..." should read -- A debris splitting grappler....--.
Line 34, "... one of both..." should read --...one or both....--.
Line 36, "...excavator stick include..." should read --...excavator stick includes….--.
Line 41, "...a frist..." should read --...a first….--.
Line 52, "...in conjuction..." should read --...in conjunction....--.
Lines 64-65, "...to controllably attached..." should read --...to be controllably attached....--.

Column 8
Line 9, "...in conjuction..." should read --...in conjunction....--.
Line 24, "...the the first..." should read --...with the first....--.

Signed and Sealed this

First Day of June, 2010

David J. Kappos

David J. Kappos
*Director of the United States Patent and Trademark Office*